United States Patent [19]

Crockett

[11] 3,962,739

[45] June 15, 1976

[54] BEDSHEETING ARRANGEMENT

[76] Inventor: Lou Anne Crockett, P.O. Box 51, Brusly, La. 70719

[22] Filed: Jan. 16, 1975

[21] Appl. No.: 541,581

[52] U.S. Cl. ..... 5/334 C
[51] Int. Cl.[2] ..... A47G 9/00
[58] Field of Search ..... 5/334 R, 334 C, 335, 5/336, 354 R, 354 B

[56] References Cited

UNITED STATES PATENTS

| | | | |
|---|---|---|---|
| 2,139,698 | 12/1938 | Schreiber | 5/334 C |
| 2,662,234 | 12/1953 | Citron | 5/334 C |
| 2,677,137 | 5/1954 | Bergin | 5/334 R |
| 2,679,056 | 5/1954 | Simpson | 5/334 C |
| 3,501,787 | 3/1970 | Nunn | 5/334 C |

*Primary Examiner*—Paul R. Gilliam
*Assistant Examiner*—Andrew M. Calvert
*Attorney, Agent, or Firm*—Roy, Kiesel & Patterson

[57] ABSTRACT

A process for manufacturing a novel bedsheeting arrangement having a top sheet and bottom sheet sewn together to a first elastic strip at one end, and a second elastic strip sewn to the bottom sheet at an end opposite the first strip.

5 Claims, 2 Drawing Figures

BEDSHEETING ARRANGEMENT

BACKGROUND OF THE INVENTION

1. Field of the Invention

This invention relates to bedclothes and more specifically to a top and bottom bedsheet combination arrangement.

2. Prior Art

Various designs have been proposed for combining top and bottom bedsheets such as those disclosed in McHorter U.S. Pat. No. 1865329 entitled "Bed Clothing," Veit U.S. Pat. No. 2498055 entitled "Bed Clothes," Nunn U.S. Pat. No. 3501787 entitled "Double Sail Sheet" and Palenski, et al. U.S. Pat. No. 3681795 entitled "Double Four Corner Contoured Bedsheet." However, there still exists a need for an arrangement that is simplier to manufacture and which can be quickly assembled on a bed mattress.

SUMMARY OF THE INVENTION

It is therefore an object of this invention to provide a simple and easy process for manufacturing a top and bottom bedsheet arrangement.

Another object of this invention is to provide a top and bottom bedsheet arrangement that can quickly be assembled on a bed mattress.

Other objects and advantages of this invention will become apparent from the ensuing descriptions of the invention.

Accordingly, a one piece bedsheeting arrangement comprising a top sheet and a fitted bottom sheet connected to the top sheet by a common elastic strip attached to the curved section of the top sheet and one of the curved sections of the bottom sheet.

In another embodiment of this invention, a process for manufacturing a one-piece bedsheeting arrangement comprising the steps of attaching by sewing the curved section of a top sheet to one of the curved sections of a bottom sheet and a strip of elastic material, and sewing a second strip of elastic material to the second curved section of the bottom sheet.

PREFERRED EMBODIMENTS OF THE INVENTION

Figure 1:
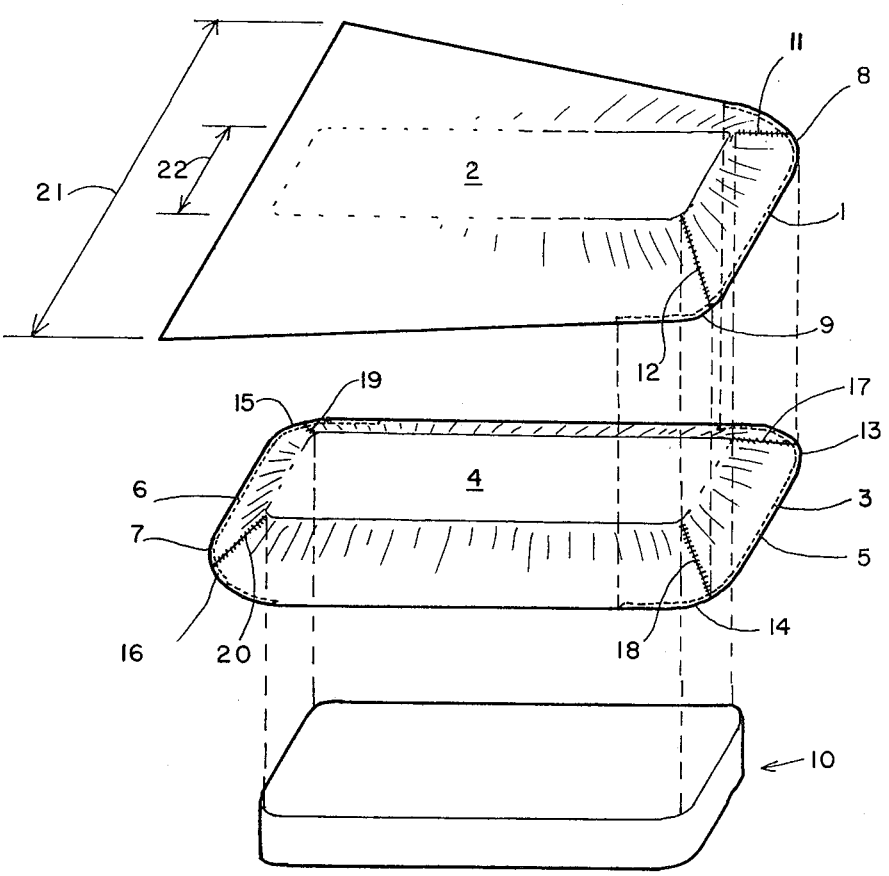
FIG. 1 is an exploded, perspective view of one embodiment of the invention.

Generally, the bedsheeting arrangement is manufactured by sewing one end 1 of a top sheet 2 to one end 3 of a bottom sheet 4 together with a first elastic strip 5, and then sewing a second elastic strip 6 to an end 7 of the bottom sheet 4 opposite end 3.

Preferably, top sheet 2 will be a rectangular sheet of cloth with one narrow end 1 having its corners 8 and 9 rounded. The curvature of the rounded corners will depend on the size of the bed mattress 10 and the positioning of darts 11 and 12 among other factors. The bottom sheet 4 will also be a rectangular sheet of cloth with all four corners 13, 14, 15 and 16 rounded. Bottom sheet end 3, as well as, bottom sheet corners 13 and 14 will more preferably match the shape of top sheet end 1 and curvature of top sheet corners 8 and 9. However, it is more preferred that the length of top sheet corners 8 and 9 be longer as the length of bottom sheet corners 8 and 9.

Bottom sheet 4 will also be fitted with darts 17, 18, 19 and 20 which are positioned to give sheet 4 a smooth fit when placed about mattress 10. Preferably, darts 11 and 12 of top sheet 2 will be positionally matched with darts 17 and 18 of bottom sheet 4.

Elastic strip 5 will be of a length sufficient to be sewn to end 3 and corners 13 and 14 of bottom sheet 3. One of the advantages of this invention is that top sheet 2, bottom sheet 4 and elastic strip 5 can be sewn together in the same number of steps it normally takes to sew one end of a fitted sheet.

In another preferred feature, end 7, as well as, corners 15 and 16 will be mirror images of end 3 and corners 13 and 14. This will simplify the cutting process of the cloth whether it is done by hand or machine. Elastic strip 6 will be of a length sufficient to be sewn to end 7 and corners 15 and 16.

Figure 2:
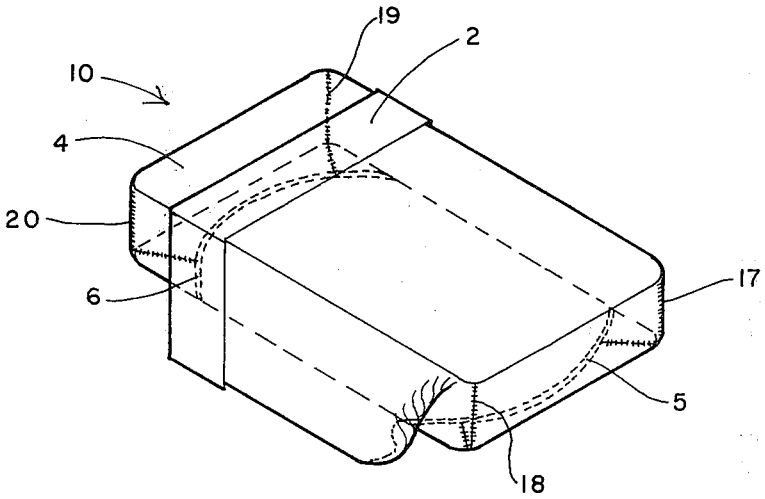
FIG. 2 is a perspective view of the bedsheeting arrangement fitted to a mattress.

In still another preferred feature, the top sheet width 21 will be wider than bottom sheet width 22. In this manner, top sheet 2 will drape over mattress 10 in the customary manner as seen in FIG. 2.

In yet another embodiment of this invention, seam binding may be used along the perimeters of top sheet 2 and bottom sheet 4 to provide smooth edges that will not fray.

It is clear from the above that there are other embodiments and features of the invention which are not mentioned specially, but which are intended to be included herein.

Having described my invention in detail, what I claim as new, novel, useful and unobvious and desire to secure by United States Letters Patent is:

1. A one-piece bedsheeting arrangement that fits about a mattress, which comprises:

a. a top sheet having rounded corners at one top sheet end and with top darts extending inward from each of said rounded corners to a point of said top sheet that will lay adjacent a corner of said mattress nearest said dart;

b. a bottom sheet having rounded corners at both bottom sheet ends, wherein said rounded corner at one end of said bottom sheet ends have an identical curvature as said rounded top sheet corners, and have bottom darts extending inward from each of said rounded corners to a point of said bottom sheet that will lay on a corner of said mattress nearest each of said darts, and connected to said top sheet by an elastic strip sewn to both sheets at said ends having said identical curvature, which elastic strip extends along said sheets' perimeter from one of said rounded corners to another of said rounded corners, and c. a second elastic strip sewn to the other end of said bottom sheet along said other end's rounded corners.

2. A bedsheeting arrangement according to claim 1 wherein said curvatures of said top sheet are longer than said curvatures of said bottom sheet.

3. A bedsheeting arrangement according to claim 1 wherein said ends of said bottom sheet are mirrored images.

4. A bedsheeting arrangement according to claim 1 wherein said top sheet has a width wider than said bottom sheet width.

5. A process for manufacturing a one-piece bed-sheeting arrangement that fits about a mattress, which comprises:

a. sewing bottom darts in each rounded corner of a bottom sheet, which bottom darts extend in an inward direction from said corners' edges to a point of said bottom sheet that will lay on a corner of said mattress nearest each of said bottom darts, b. sewing top darts in both rounded corners of a top sheet, which rounded corners are at one end of said top sheet, and which top darts extend in an inward direction from said corner's edges to a point of said top sheet that will lay adjacent to a corner of said mattress nearest each of said top darts, c. sewing both of said rounded corners of said top sheet and said rounded corners of one end of a said bottom sheet together to an elastic strip which elastic strip extends along said sheets' perimeters from one of said rounded corners to another of said rounded corners, and d. sewing a second elastic strip to said bottom sheet's end opposite said end to which said first elastic strip had been sewn, which second elastic strip extends along said bottom sheets' perimeter from one of said rounded corners of said opposite end to another of said rounded corners of said opposite end.

* * * * *